US006744015B2

(12) United States Patent
Tanaka et al.

(10) Patent No.: US 6,744,015 B2
(45) Date of Patent: Jun. 1, 2004

(54) HEATER AND METHOD FOR MANUFACTURING THE SAME

(75) Inventors: Katsuhiko Tanaka, Aichi (JP); Masakazu Nagasawa, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 138 days.

(21) Appl. No.: 10/157,975

(22) Filed: May 31, 2002

(65) Prior Publication Data

US 2002/0195443 A1 Dec. 26, 2002

(30) Foreign Application Priority Data

May 31, 2001 (JP) ..... 2001-164619

(51) Int. Cl.[7] ..... F23Q 7/22
(52) U.S. Cl. ..... 219/267; 219/270
(58) Field of Search ..... 219/267, 270, 219/544; 123/145 A, 145 R

(56) References Cited

U.S. PATENT DOCUMENTS

| | | | | | |
|---|---|---|---|---|---|
| 4,087,904 | A | * | 5/1978 | Steinke et al. | 29/611 |
| 5,084,607 | A | * | 1/1992 | Shafer et al. | 219/270 |
| 5,589,091 | A | * | 12/1996 | Muller | 219/270 |
| 5,882,233 | A | * | 3/1999 | Idehara | 439/877 |
| 6,252,200 | B1 | * | 6/2001 | Heinz et al. | 219/270 |
| 6,657,166 | B2 | * | 12/2003 | Funaki et al. | 219/270 |

FOREIGN PATENT DOCUMENTS

| | | | | |
|---|---|---|---|---|
| JP | 58000022 | * | 1/1983 | 219/270 |
| JP | 63-311022 | | 12/1988 | |
| JP | 01046520 | * | 1/1989 | |
| JP | 6-331145 | | 11/1994 | |
| JP | 11-2406 | | 1/1999 | |
| JP | 11-176563 | | 7/1999 | |

* cited by examiner

*Primary Examiner*—Edward K. Look
*Assistant Examiner*—Vinod D. Patol
(74) *Attorney, Agent, or Firm*—Finnegan, Henderson, Farabow, Garrett & Dunner, LLP

(57) ABSTRACT

The present invention provides an inexpensive heater exhibiting good gas-tightness, as well as a method for manufacturing the same. The heater includes a cylindrical metallic shell having a through-hole with a heating element disposed in the through-hole such that a portion projects from one end of the shell. The heater is adapted to generate heat upon application of electricity thereto. A rod-like axial member has a coil lead for electrically connecting a portion of the axial member and the heating element. A gas-tight seal member formed of an insulating polymeric material is interposed between the axial member and the inner surface of the through-hole in such a manner to surround the outer circumferential surface of the axial member. A crimped portion of the metallic shell brings the gas-tight seal member into close contact with the outer circumferential surface of the axial member and the inner wall surface of the through-hole form a gas tight seal.

18 Claims, 11 Drawing Sheets

Fig. 9

| MATERIAL | VICKERS HARDNESS Hv | CIRCUMFERENTIAL LENGTH G (mm) X LENGTH L OF CRIMPED PORTION (mm) = TOTAL CONTACT AREA S ($mm^2$) | | | | | | | |
|---|---|---|---|---|---|---|---|---|---|
| | | 16.6 x 2.5 = 41.5 | | 16.6 x 3.0 = 49.8 | | 16.6 x 6.0 = 99.6 | | 16.6 x 10.0 = 166 | |
| | | TENSILE STRENGTH OF AXIAL MEMBER | AIR-TIGHT-NESS | TENSILE STRENGTH OF AXIAL MEMBER | AIR-TIGHT-NESS | TENSILE STRENGTH OF AXIAL MEMBER | AIR-TIGHT -NESS | TENSILE STRENGTH OF AXIAL MEMBER | AIR-TIGHT-NESS |
| POLYAMIDE | UP TO 10 | X | X | X | O | X | O | X | O |
| 30% GF POLYAMIDE | 10-20 | X | X | O | O | O | O | O | O |
| PEEK | 20-40 | O | X | O | O | O | O | O | O |
| PPA | 40-60 | O | X | O | O | O | O | O | O |
| PHENOL A | 60-80 | O | X | O | O | O | O | O | O |
| PHENOL B | 80 OR MORE | X (CRACKING OF RESIN) | X | X (CRACKING OF RESIN) | X | - | - | - | - |

METALLIC SHELL: OUTSIDE DIA. OF TRUNK PORTION D = 801 mm; BORE DIA. OF THROUGH-HOLE K = 5.6 mm; DISTANCE BETWEEN OPPOSED SIDES T = 7.3 mm
AXIAL MEMBER: OUTSIDE DIA. C = 3.5 mm
GASTIGHT SEAL MEMBER: OUTSIDE DIA. U = 5.5 mm; LENGTH N = 15 mm (BEFORE CRIMPING)

HARDNESS: MICRO HARDNESS TESTER, HV INDENTER, 100 g x 15 sec
TENSILE STRENGTH ON AXIAL MEMBER: THE MARK "O" DENOTES AN AXIAL TENSILE STRENGTH NOT LESS THEN 2,000 N, AND THE MARK "X" DENOTES AN AXIAL TENSILE STRENGTH LESS THAN 2,000 N, AS MEASURED IN THE TENSILE TEST ON THE AXIAL MEMBER.
GASTIGHTNESS: THE MARK "O" DENOTES THAT NO LEAKAGE OCCURRED AT A GAS PRESSURE OF 1.5 MPa in the GASTIGHTNESS TEST, AND THE MARK "X" DENOTES THAT GAS LEAKAGE OCCURRED.

Fig. 10

| MATERIAL | VICKERS HARDNESS Hv | CIRCUMFERENTIAL LENGTH G (mm) x LENGTH L OF CRIMPED PORTION (mm) = TOTAL CONTACT AREA S ($mm^2$) | | | | | | | | | |
|---|---|---|---|---|---|---|---|---|---|---|---|
| | | 13.5 x 2.5 = 33.75 | | 13.5 x 3.0 = 40.5 | | 13.5 x 3.5 = 47.25 | | 13.5 x 6.0 = 81.0 | | 13.5 x 10.0 = 135 | |
| | | TENSILE STRENGTH OF AXIAL MEMBER | AIR-TIGHT-NESS | TENSILE STRENGTH OF AXIAL MEMBER | AIR-TIGHT-NESS | TENSILE STRENGTH OF AXIAL MEMBER | AIR-TIGHT-NESS | TENSILE STRENGTH OF AXIAL MEMBER | AIR-TIGHT-NESS | TENSILE STRENGTH OF AXIAL MEMBER | AIR-TIGHT-NESS |
| POLYAMIDE | UP TO 10 | X | X | X | X | X | O | X | O | X | O |
| 30% GF POLYAMIDE | 10-20 | X | X | X | X | O | O | O | O | O | O |
| PEEK | 20-40 | O | X | O | X | O | O | O | O | O | O |
| PPA | 40-60 | O | X | O | X | O | O | O | O | O | O |
| PHENOL A | 60-80 | O | X | O | X | O | O | O | O | O | O |
| PHENOL B | 80 OR MORE | X (CRACKING OF RESIN | X | X (CRACKING OF RESIN | X | X (CRACKING OF RESIN | X | - | - | - | - |

METALLIC SHELL: OUTSIDE DIA. OF TRUNK PORTION D = 6.6 mm; BORE DIA. OF THROUGH-HOLE K = 4.5 mm; DISTANCE BETWEEN OPPOSED SIDES T = 7.3 mm

AXIAL MEMBER: OUTSIDE DIA. C = 3.0 mm

GASTIGHT SEAL MEMBER: OUTSIDE DIA. U = 4.4 mm; LENGTH N = 15 mm (BEFORE CRIMPING)

HARDNESS: MICRO HARDNESS TESTER, HV INDENTER, 100 g x 15 sec

TENSILE STRENGTH ON AXIAL MEMBER: THE MARK "O" DENOTES AN AXIAL TENSILE STRENGTH NOT LESS THEN 2,000 N, AND THE MARK "X" DENOTES AN AXIAL TENSILE STRENGTH LESS THAN 2,000 N, AS MEASURED IN THE TENSILE TEST ON THE AXIAL MEMBER.

GASTIGHTNESS: THE MARK "O" DENOTES THAT NO LEAKAGE OCCURRED AT A GAS PRESSURE OF 1.5 MPa IN THE GASTIGHTNESS TEST, AND THE MARK "X" DENOTES THAT GAS LEAKAGE OCCURRED.

HEATER AND METHOD FOR MANUFACTURING THE SAME

FIELD OF THE INVENTION

The present invention relates to a heater capable of raising the temperature of a heating element portion thereof through supply of electricity to the portion, such as a glow plug used in an internal combustion engine for improving start-up of the engine, and to a method for manufacturing the same.

BACKGROUND OF THE INVENTION

In order to improve the start-up of a diesel engine at low temperature, the heating element of a glow plug is disposed within the combustion chamber. Applying electricity to the glow plug heats the heating element and accelerates ignition of fuel, thereby enhancing start-up.

In some cases, in order to heat a liquid such as cooling water or a gas such as air in an engine, a glow plug may be used as a heater. Similarly, a heater having a similar configuration may be used as a heat source for igniting kerosene or a gas.

A glow plug is generally configured in the following manner: a heating element is disposed in a cylindrical metallic shell in such a manner as to project from the front end of the metallic shell. One electrode of the heating element is electrically connected to the metallic shell while the other electrode is electrically led to an external terminal, which is disposed in the vicinity of the rear end of the metallic shell while being electrically insulated from the metallic shell, by use of a rod-like axial member, a lead wire, or other electrically conductive member.

However, in an engine, since the heating element of a glow plug is disposed within a combustion chamber or a prechamber, which is exposed to high pressure, the glow plug must be gas-tight such that a gas within the combustion chamber does not leak through the glow plug (through the metallic shell) to the exterior of the glow plug.

When a heating element is configured such that a heating resistor, formed of a high-melting-point metal wire, together with a ceramic powder heat resistant insulation, such as MgO, is disposed within a closed-bottomed cylindrical metal sheath, the glow plug must also be gas-tight. This prevents the ceramic powder insulation from absorbing moisture and deteriorating in insulating performance, from entry of water, water vapor, or oil from the side toward the external terminal (the side toward the rear end of the metallic shell).

Also, a heater that serves as an ignition heat source for heating water or the like must be gas-tight so as to prevent leakage of water, water vapor, or the like to the exterior of the heater or entry of the same into the heater, through the metallic shell.

In order to establish such gas-tightness, a glow plug or a like heater employs a seal mechanism, such as a glass seal or an O-ring, provided in the vicinity of the rear end portion of the metallic shell. However, employment of a seal mechanism such as a glass seal or an O-ring involves various problems such as an increased number of manufacturing steps, resulting in increased cost.

The present invention has been accomplished in view of the above-mentioned problems, and an object of the invention is to provide an inexpensive heater with good gas-tightness, as well as a method for manufacturing the same.

SUMMARY OF THE INVENTION

The present invention is a heater comprising a cylindrical metallic shell having a front end, a rear end, and a through-hole extending therein between the front end and the rear end. A heating element is disposed in the through-hole of the metallic shell such that a portion thereof projects from the front end of the metallic shell. The heating element is adapted to generate heat upon application of electricity thereto. A lead member extends through the through-hole at least from the rear end of the metallic shell while being electrically insulated from the metallic shell, and electrically connected to the heating element. A gas-tight seal member, formed of an insulating polymeric material, is interposed between the lead member and an inner wall surface of the through-hole of the metallic shell in such a manner as to surround at least a longitudinal portion of the lead member. The metallic shell includes a crimped portion at which the metallic shell is crimped from an outer surface thereof to bring the gas-tight seal member into close contact with the lead member and the inner wall surface of the through-hole. This maintains gas-tightness within the through-hole between the side toward the front end and the side toward the rear end with respect to the gas-tight seal member.

In the heater of the present invention, the metallic shell includes a crimped portion at which the gas-tight seal member is in close contact with the lead member and the inner wall surface of the through-hole, to thereby maintain gas-tightness between the side toward the front end and the side toward the rear end with respect to the gas-tight seal member.

Thus, when this heater is used as a glow plug, leakage of high-pressure gas within the combustion chamber of an engine from the side toward the front end to the side toward the rear end can be prevented. Also, entry of water, such as water vapor, or oil from the side toward the rear end to the side toward the front end can be prevented, thereby preventing deterioration of the heat resistant insulation powder within the heating element.

The heater of the invention can establish gas-tightness without provision of a seal mechanism, such as a glass seal or an O-ring, at a rear end portion of the metallic shell, and is therefore inexpensive.

Examples of a heater to which the present invention is applicable include a glow plug used in a diesel engine for assisting start-up, and a heater used as a heat source for heating a liquid such as water or a gas such as air, or for igniting kerosene or the like.

Preferably, the present invention is applied to a heater to be used as a glow plug. That is, preferably, a glow plug comprises a cylindrical metallic shell having a front end, a rear end, and a through-hole extending therein between the front end and the rear end. A heating element is disposed in the through-hole of the metallic shell such that a portion thereof projects from the front end of the metallic shell. The heater portion is adapted to generate heat upon application of electricity thereto. A lead member extends through the through-hole, at least from the rear end of the metallic shell, while being electrically insulated from the metallic shell. The lead member is electrically connected to the heating element. A gas-tight seal member, formed of an insulating polymeric material is interposed between the lead member and an inner wall surface of the through-hole of the metallic shell in such a manner as to surround at least a longitudinal portion of the lead member. In the glow plug, the metallic shell includes a crimped portion at which the metallic shell is crimped from an outer surface thereof so as to bring the gas-tight seal member into close contact with the lead member and the inner wall surface of the through-hole, to maintain gas-tightness within the through-hole between the side toward the front end and the side toward the rear end with respect to the gas-tight seal member.

Preferably, the heater of the present is gas-tight such that no leakage arises in the course of a gas-tightness test conducted through application of a gas pressure of 1.5 MPa to the gas-tight seal member from the side toward the front end.

The heater of the present invention has high gas-tightness such that no leakage arises even when high gas pressure is imposed thereon. Thus, gas-tightness can be reliably maintained between the side toward the front end and the side toward the rear end with respect to the gas-tight seal member.

Having such high gas-tightness, the heater used as a glow plug exhibits high reliability.

Preferably, the above-described heater is configured such that a total contact area S between the gas-tight seal member and the inner wall surface of the through-hole as measured in a region located radially inward of the crimped portion is not less than 45 $mm^2$.

In this heater, the gas-tight seal member has a predetermined total contact area, as measured inside the crimped portion, such that it can remain gas tight when exposed to the application of a gas pressure of 1.5 MPa.

Preferably, any one of the above-described heaters is configured such that the lead member comprises a rod-like axial member and a connection member for electrically connecting the front end portion of the lead member and the heating element, and the gas-tight seal member is interposed between the axial member and the inner wall surface of the through-hole of the metallic shell in such a manner as to surround at least a certain longitudinal portion of the axial member.

In the heater of the present invention, since the lead member includes the rod-like axial member, as compared with the case of using a fine wire in place of the axial member, electrical resistance can be reduced, and the area of contact with the gas-tight seal member can be increased. Accordingly, it becomes difficult to axially draw the axial member from the gas-tight seal member; i.e., the axial member and the gas-tight seal member are joined with high strength, and thus the axial member and the metallic shell are joined strongly via the gas-tight seal member.

Use of this heater as a glow plug is particularly preferred, for the following reason. Since the axial member can be fixedly attached to the metallic shell via the gas-tight seal member, even when the axial member is subjected to vibration associated with engine operation, free vibration of the axial member can be prevented, thereby enhancing durability of the glow plug.

Preferably, the above-described heater is configured such that an outer circumferential surface of the axial member to be covered with the gas-tight seal member is at least partially roughened.

In the heater of the present invention, since a portion of the outer circumferential surface of the axial member is roughened, good adhesion is attained between the gas-tight seal member and the outer circumferential surface of the axial member, thereby enhancing gas-tightness of the heater. Also, the axial member becomes unlikely to axially come off the gas-tight seal member; i.e., the metallic shell.

No particular limitation is imposed on a roughening process, so long as the outer circumferential surface of the axial member is roughened. Examples of such a roughening process include a mechanical roughening process such as knurling, sandpapering, or sandblasting, and a chemical roughening process.

Preferably, at least an inner wall surface of the through-hole of the metallic shell to be covered with the gas-tight seal member is at least partially roughened.

Such roughening establishes good adhesion between the gas-tight seal member and the inner wall surface of the through-hole of the metallic shell, thereby further enhancing gas-tightness of the heater. Also, the axial member becomes unlikely to axially come off the gas-tight seal member; i.e., the metallic shell.

When the axial member projects from the rear end of the metallic shell so as to serve as an external terminal, or when the axial member is fixedly attached to an external terminal in the vicinity of the rear end of the metallic shell, it is preferred that the outer circumferential surface of the axial member to be covered with the gas-tight seal member is at least partially roughened as described above.

Since a connection terminal of a power cord is fixedly or removably attached to the external terminal, the external terminal must be fixedly attached to the metallic shell so as not to be extracted along the axial direction. When the axial member is used as an external terminal or when the axial member is fixedly attached to an external terminal, roughening the surface of the axial member as described above allows the axial member to be reliably fixed to the metallic shell.

Preferably, any one of the above-described heaters is configured such that the gas-tight seal member has a Vickers hardness HV of 10–80 as measured at a position located radially inward of the crimped portion. This affixes the axial member within the seal member such that it takes a tensile force of not less than 2,000 N to extract the axial member from the seal member.

More preferably, the gas-tight seal member has a Vickers hardness HV of 20–80, for the following reason. When the hardness HV is less than 20, for example, the gas-tight seal member is prone to deformation during the course of a tensile test on the axial member. Therefore, in order to enhance the tensile strength of the axial member for stronger fixation of the axial member, the length of a crimped portion must be increased.

Still more preferably, the gas-tight seal member has a Vickers hardness HV of 20–60, for the following reason. When the hardness HV exceeds 60, there is a possibility that the gas-tight seal member may be cracked in the course of crimping.

The gas-tight seal member is preferably formed of a thermoplastic resin, for the following reason. By employment of thermoplastic resin, the gas-tight seal member can be readily formed on the lead member such as the axial member through injection molding or a like process.

Also, the gas-tight seal member is preferably formed of a heat-resistant polymeric material; specifically, a polymeric material having a melting point not lower than 200° C. Specific examples of such a polymeric material include polyether ether ketone (PEEK) and polyphthalamide (PPA). Such polymeric materials are preferred, for the following reason. When the heater is used as a glow plug, the gas-tight seal member is possibly exposed to a high temperature of at least 150° C., although the temperature depends on the position of the gas-tight seal member and specifications of an engine.

Another embodiment of the invention is a method for manufacturing a heater. The method includes the step of disposing a heating-element-lead-member assembly in a through-hole of a cylindrical metallic shell having a front end, a rear end, with the through-hole extending therein between the front end and the rear end, such that a portion of the heating element projects from the front end, and the lead member extends to the rear end. The heating-element-lead-member assembly comprises a heating element adapted to generate heat upon application of electricity thereto, and a lead member electrically connected to the heating element and including a gas-tight seal member. The gas-tight seal member surrounds at least a longitudinal portion of the lead member and is formed of an insulating polymeric material. The method further includes crimping the metallic shell from an outer surface thereof so as to bring the gas-tight seal member into close contact with the lead member and an inner wall surface of the through-hole, to thereby maintain gas-tightness within the through-hole between a side toward the front end and a side toward the rear end with respect to the gas-tight seal member.

According to the method for manufacturing a heater of the present invention, the gas-tight seal member is formed of an insulating polymeric material beforehand in such a manner as to surround at least a longitudinal portion of the lead member, and the resultant assembly is disposed within the through-hole of the metallic shell in the disposing step. Thus, the disposing step can be readily carried out merely through insertion of the heating-element-lead-member assembly into the through-hole of the metallic shell. Also, the gas-tight seal member can be disposed at a predetermined position without need to perform a particular positioning operation.

In another aspect, a method is provided for manufacturing a heater. The method includes the step of disposing a heating-element-axial-member assembly in a through-hole of a cylindrical metallic shell having a front end, a rear end, and the through-hole extending therein between the front end and the rear end, such that a portion of the heating element projects from the front end. The heating-element-axial-member assembly comprises a heating element, adapted to generate heat upon application of electricity thereto, an axial member formed of a metal and including a gas-tight seal member, and a connection member for electrically connecting the heating element and a front end portion of the axial member, the gas-tight seal member surrounding at least a longitudinal portion of the axial member and being formed of an insulating polymeric material. The method includes the step of crimping the metallic shell from an outer surface thereof so as to bring the gas-tight seal member into close contact with the axial member and an inner wall surface of the through-hole, to thereby maintain gas-tightness within the through-hole between a side toward the front end and a side toward the rear end with respect to the gas-tight seal member.

According to the method for manufacturing a heater of the present invention, the gas-tight seal member formed of an insulating polymeric material is formed beforehand in such a manner as to surround at least a certain longitudinal portion of the axial member, and the resultant assembly is disposed within the through-hole of the metallic shell in the disposing step. Thus, the disposing step can be readily carried out merely through insertion of the heating-element-axial-member assembly into the through-hole of the metallic shell. Also, the gas-tight seal member can be disposed at a predetermined position without need to perform a particular positioning operation.

BRIEF DESCRIPTION OF THE DRAWINGS

FIG. 2(*b*) is a partially cutaway sectional view showing a state in which a portion of the axial member is covered with a gas-tight seal member.

FIG. 9 is a table showing the results of the tensile strength test on the axial member and the gas-tight test with respect to the heaters of the embodiment, with the length of a crimped portion and the hardness of the gas-tight seal member serving as parameters.

FIG. 10 is a table showing the results of the tensile strength test on the axial member and the gas-tight test with respect to heaters of a modified embodiment, with the length of a crimped portion and the hardness of the gas-tight seal member serving as parameters.

DESCRIPTION OF THE PREFERRED EMBODIMENTS

Figure 1:
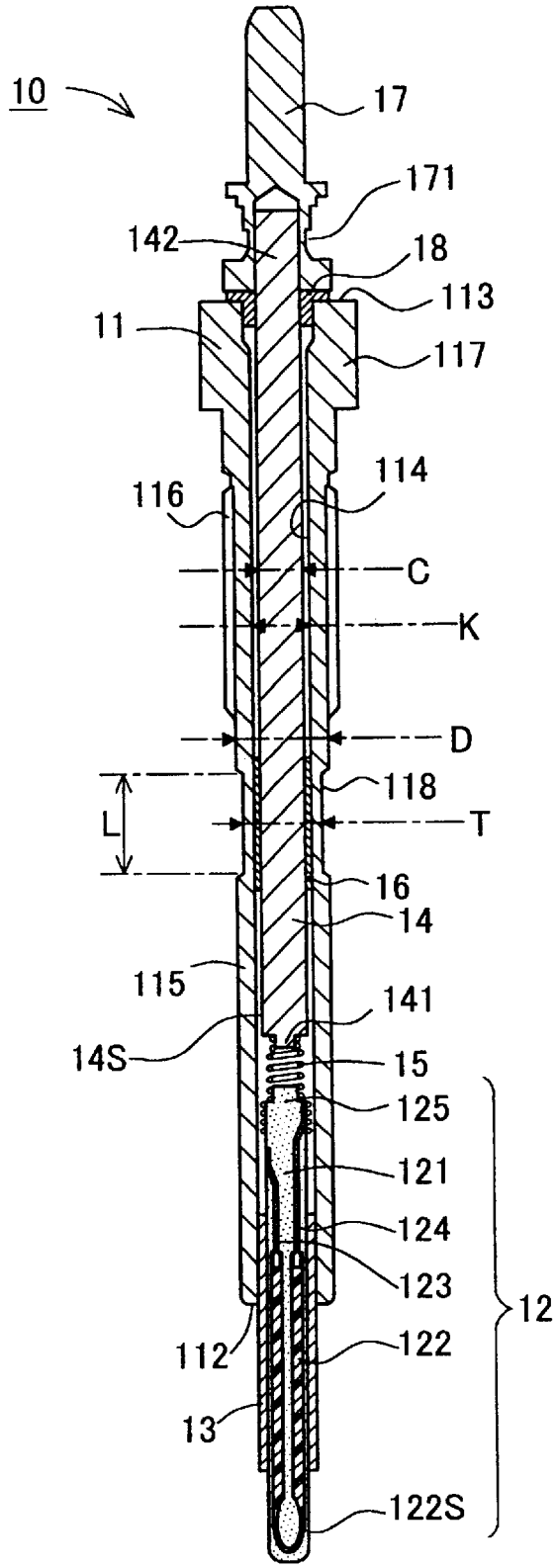
FIG. 1 is a cross-sectional view of a heater according to the present invention wherein the heater is embodied in a glow plug.

A first embodiment of the present invention will next be described with reference to FIGS. 1 to 8. A heater 10 is also used as a glow plug. A metallic shell 11, formed of a carbon steel, has a through-hole 114 extending therethrough between a front end 112 and a rear end 113. A heating element 12, a rod-like axial member 14, and a coil lead 15 for connecting the heating element 12 and the axial member 14 are disposed within the through-hole 114 such that the front end (lower end in FIG. 1) of the heating element 12 projects from the front end 112. A male-threaded portion 116 of the nominal size M10 for mounting the metallic shell 11 to an engine or the like is formed on a trunk portion 115 of the metallic shell 11. A hexagonal tool engagement portion 117 to be engaged with a tool such as a wrench is formed at a rear end portion of the metallic shell 11.

The heating element 12 is a so-called ceramic heating element and is configured in the following manner. A substantially U-shaped electrically conductive portion 122 containing a predominant amount of WC or $MoSi_2$ is covered with an insulating ceramic portion 121 containing a predominant amount of silicon nitride. Leads 123 and 124 are connected to the corresponding ends of the electrically conductive portion 122 for external connection on a side surface of the insulating ceramic portion 121. A heating portion 122S located in the vicinity of the front end (lower end) of the electrically conductive portion 122 is smaller in diameter than the remaining part of the electrically conductive portion 122. Heat is generated mainly by the heating portion 122S upon application of electricity thereto, whereby the front end portion of the heating element 12 generates heat.

The heating element 12 extends through and is brazed to a sleeve 13, while the sleeve 13, in turn, is brazed to the metallic shell 11, whereby one end of the electrically conductive portion 122 is electrically connected to the metallic shell 11 via the lead 123 and the sleeve 13.

The other end of the electrically conductive portion 122 is extended to a rear end portion 125 by the lead 124. The rear end portion 125 and a front end portion 141 of the axial member 14 are electrically connected by means of the coil lead 15, which is formed through coiling of a nickel lead wire.

The axial member 14, which is formed of a ferrous material, projects rearward (upward in FIG. 1) from the rear end 113 of the metallic shell 11. An annular insulation bushing 18 is fitted into the through-hole 114 and onto the axial member 14 from the rear end 113, thereby holding the axial member 14 while electrically insulating the axial member 14 from the metallic shell 11. An external terminal 17 is fitted to a rear end portion 142 of the axial member 14 and is circumferentially crimped from outside to thereby form a terminal-crimped portion 171, whereby the external terminal 17 and the axial member 14 are fixedly unified.

In this heater 10, when voltage is applied between the external terminal 17 and the metallic shell 11, current flows from the external terminal 17 to the metallic shell 11 via the axial member 14, the coil lead 15, the lead 124, the electrically conductive portion 122, the lead 123, and the sleeve 13, whereby the heating portion 122S of the electrically conductive portion 122 generates heat.

In this heater 10, a gas-tight seal member 16 formed of an insulating polymeric material is interposed between the through-hole 114 and a portion of the axial member 14 disposed within the through-hole 114. A part of the trunk portion 115 of the metallic shell 11 located radially outward of the gas-tight seal member 16 is circumferentially crimped from outside into a hexagonal shape, thereby forming a crimped portion 118. At this crimped portion 118, the gas-tight seal member 16 formed of PEEK is in close contact with the inner wall surface of the through-hole 114 and the outer circumferential surface 14S of the axial member 14, thereby maintaining gas-tightness between the side toward the front end (the lower side in FIG. 1) and the side toward the rear end (the upper side in FIG. 1) with respect to the gas-tight seal member 16.

In the vicinity of the crimped portion 118, the trunk portion 115 has an outside diameter D of 8.1 mm; the through-hole 114 has a bore diameter K of 5.6 mm; and the axial member 14 has an outside diameter of 3.5 mm. The crimped portion 118 has the following dimensions: distance between opposed sides T=7.3 mm; and length L=6 mm.

Thus, for example, even when the heater 10 is mounted on an engine such that the heating element 12 is located within the combustion chamber or prechamber of the engine, high-pressure combustion gas does not leak out from the rear end 113 of the metallic shell 11 via the through-hole 114. Also, there is prevented entry of water, water vapor, oil, or a like substance from the rear end 113 to the side toward the front end 112 with respect to the gas-tight seal member 16 through the through-hole 114.

Next, a method for manufacturing the heater embodied as a glow plug 10 will be described.

Figure 2:
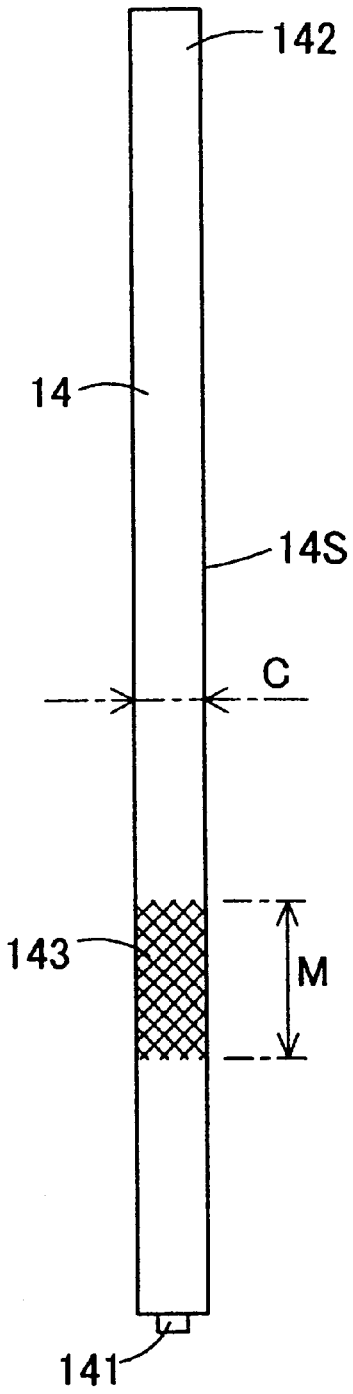
FIG. 2(*a*) is a side view of an axial member.
Figure 2:
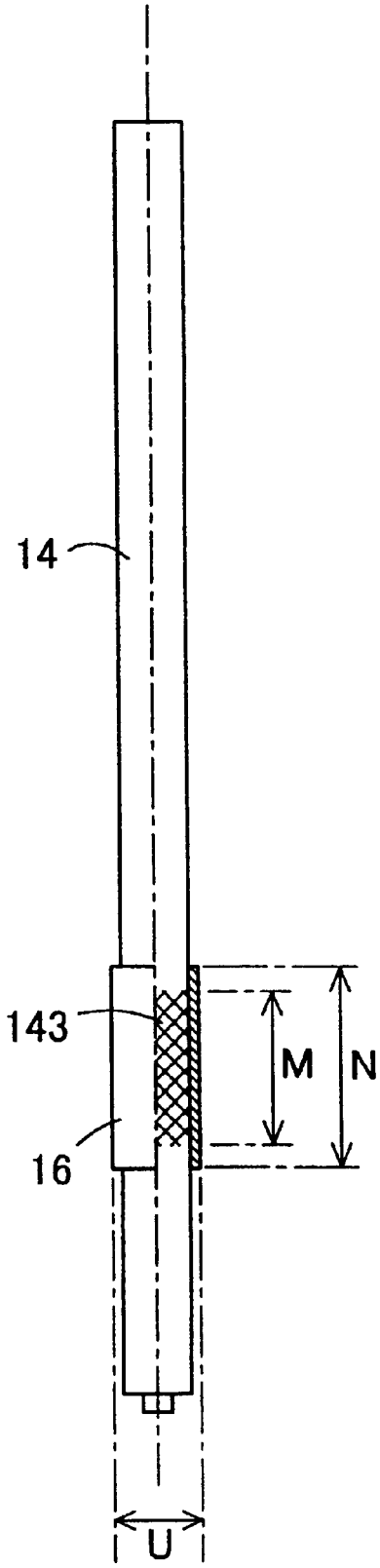

First, the axial member 14 is prepared. As shown in FIG. 2(*a*), a portion of the outer circumferential surface 14S of the axial member 14 is knurled to thereby form a knurled portion 143 having an axial length M of 10 mm. Next, as shown in FIG. 2(*b*), the gas-tight seal member 16 having an outside diameter U of 5.5 mm and a length N of 15 mm is formed of PEEK through injection molding in such a manner as to cover the knurled portion 143.

Since the gas-tight seal member 16 is formed in such a manner as to cover the knurled portion 143, the gas-tight seal member 16 is strongly attached to the axial member 14. Accordingly, even when an axial force is imposed on the axial member 14 as in the case of a tensile test on the axial member 14, which will be described later, extraction of the axial member 14 from the gas-tight seal member 16 is prevented.

The length N of the gas-tight seal member 16 is rendered greater than the length M of the knurled portion 143 so as to completely cover the knurled portion 143 with the gas-tight seal member 16, thereby preventing a problem in that a resin leaks out along knurl grooves as in the course of injection molding.

Figure 3:
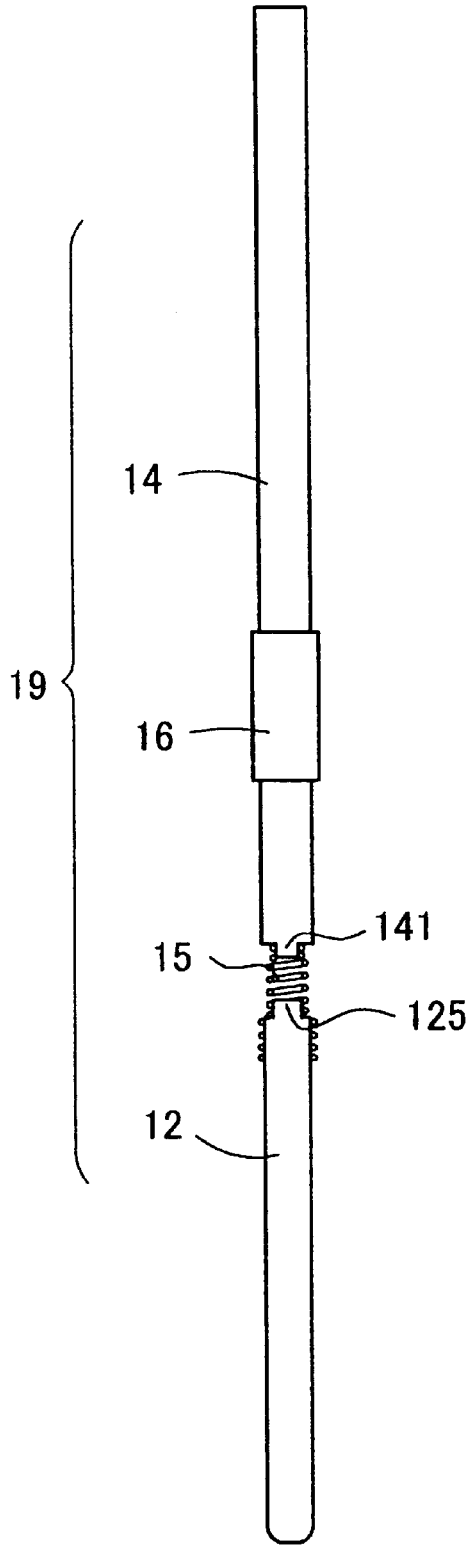
FIG. 3 is a side view of a heating-element-axial-member assembly configured such that the axial member and the heating element are connected by means of a coil lead.

Next, as shown in FIG. 3, the coil lead 15 is brazed to a front end portion 141 of the axial member 14 and to the rear end portion 125 of the heating element 12, which has been prepared beforehand by a known method, to thereby electrically connect the heating element 12 and the axial member 14 via the coil lead 15, whereby a heating-element-axial-member assembly 19 is formed.

Figure 4:
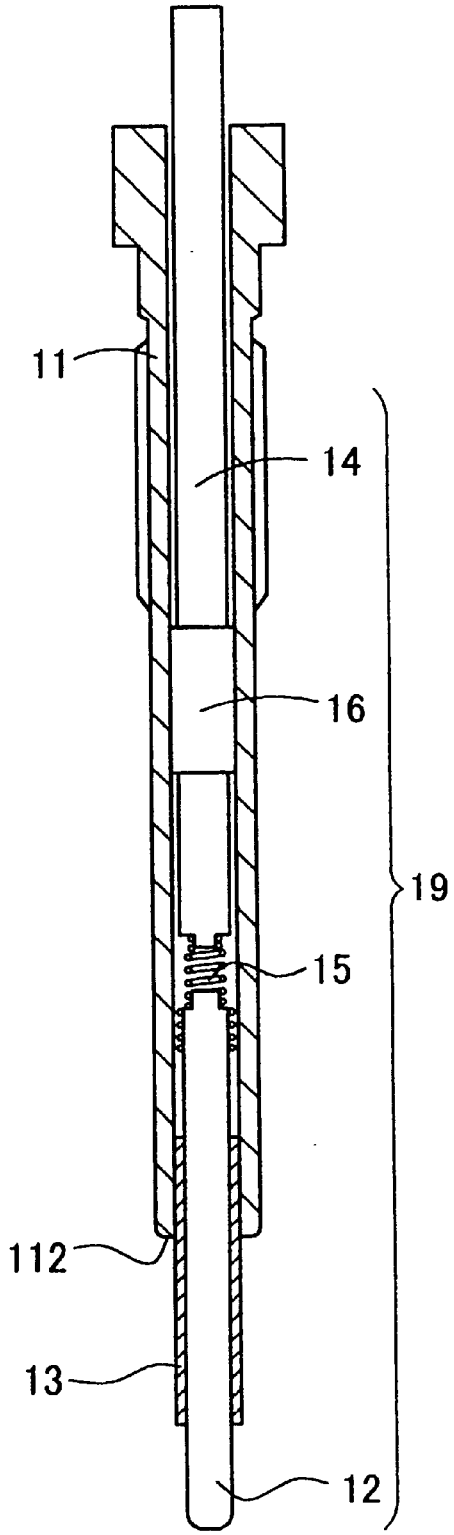
FIG. 4 is a partially cutaway sectional view showing a state in which the heating-element-axial-member assembly is disposed within a metallic shell.

The sleeve 13 is fitted to the heating element 12 of the heating-element-axial-member assembly 19 and is brazed to the heating element 12 along the circumferential direction. As shown in FIG. 4, the resultant assembly is inserted into the through-hole 114 of the metallic shell 11 such that a front end portion of the heating element 12 projects from the front end 112 of the metallic shell 11. Since the outside diameter of the gas-tight seal member 16 is 5.5 mm and is smaller than a bore diameter of 5.6 mm of the through-hole 114, the axial member 14, etc. can be easily disposed within the metallic shell 11. Subsequently, the sleeve 13 and the metallic shell 11 are brazed to thereby fixedly attach the heating member 12 to the metallic shell 11. Thus, one end of the electrically conductive portion 122 of the heating element 12 is electrically connected to the metallic shell 11 via the lead 123 and the sleeve 13.

Figure 5:
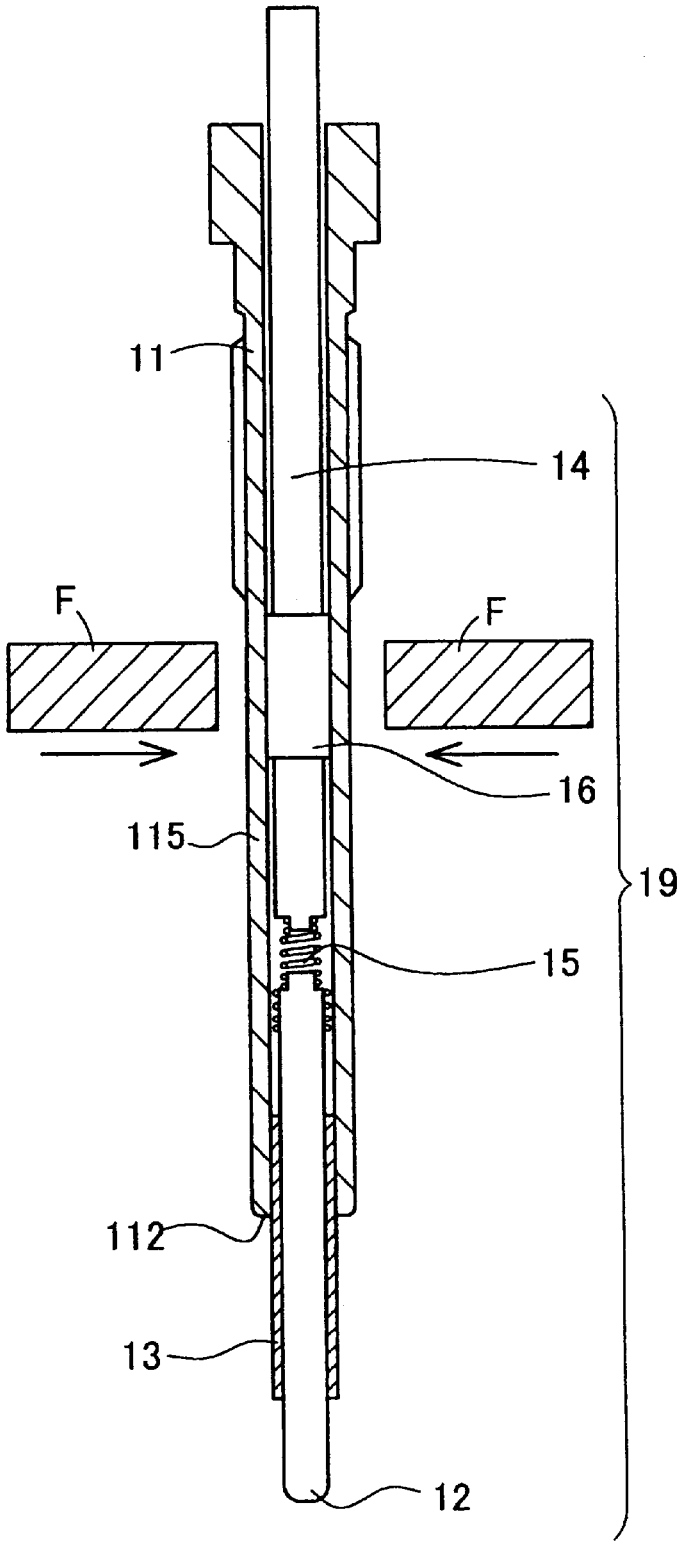
FIG. 5 is a partial cross-sectional view showing a crimping process for bringing the gas-tight seal member in close contact with the outer circumferential surface of the axial member and the inner wall surface of a through-hole of the metallic shell.

Next, as shown in FIG. 5, a part of the trunk portion 115 of the metallic shell 11 located radially outward of the gas-tight seal member 16 is crimped into a hexagonal shape by use of a crimping jig F, thereby forming the crimped portion 118 having the following dimensions: distance between opposed sides T=7.3 mm; and length L=6 mm (see FIG. 1). Within the crimped portion 118, the gas-tight seal member 16 is brought in close contact with the outer circumferential surface 14S of the axial member 14 under pressure, and is brought in close contact with the inner wall surface of the through-hole 114 under pressure. Thus, the gas-tight seal member 16 is strongly fixed between the axial member 14 and the wall of the through-hole 114; in other words, the axial member 14 is strongly fixed to the metallic shell 11 via the gas-tight seal member 16. Also, gas-tightness is maintained between the side toward the front end 112 of the metallic shell 11 and the side toward the rear end 13 of the metallic shell 11.

Subsequently, the insulation bush 18 is fitted onto the axial member 14 and into the through-hole 114 at the rear end 113 of the metallic shell 11; the external terminal 17 is fitted onto the rear end portion 142 of the axial member 14; and the external terminal 17 is circumferentially crimped from outside to thereby form the terminal-crimped portion 171, thereby completing the heater 10 shown in FIG. 1. In contrast to a conventional heater (glow plug), which establishes gas-tightness and holds an axial member, by means of an O-ring and a glass seal disposed at a rear end portion of a metallic shell, the heater 10 is configured such that the gas-tight seal member 16 is formed on the axial member 14 by use of an insulating polymeric material, and is crimped together with the metallic shell 11, thereby establishing gas-tightness and holding the axial member 14. Therefore, the heater 10 can be manufactured more easily.

Evaluation Test

In order to examine the influence of dimensions of the crimped portion 118 and the material of the gas-tight seal member 16 on heater properties, the heater 10 was subjected to an evaluation test described below.

Figure 6:
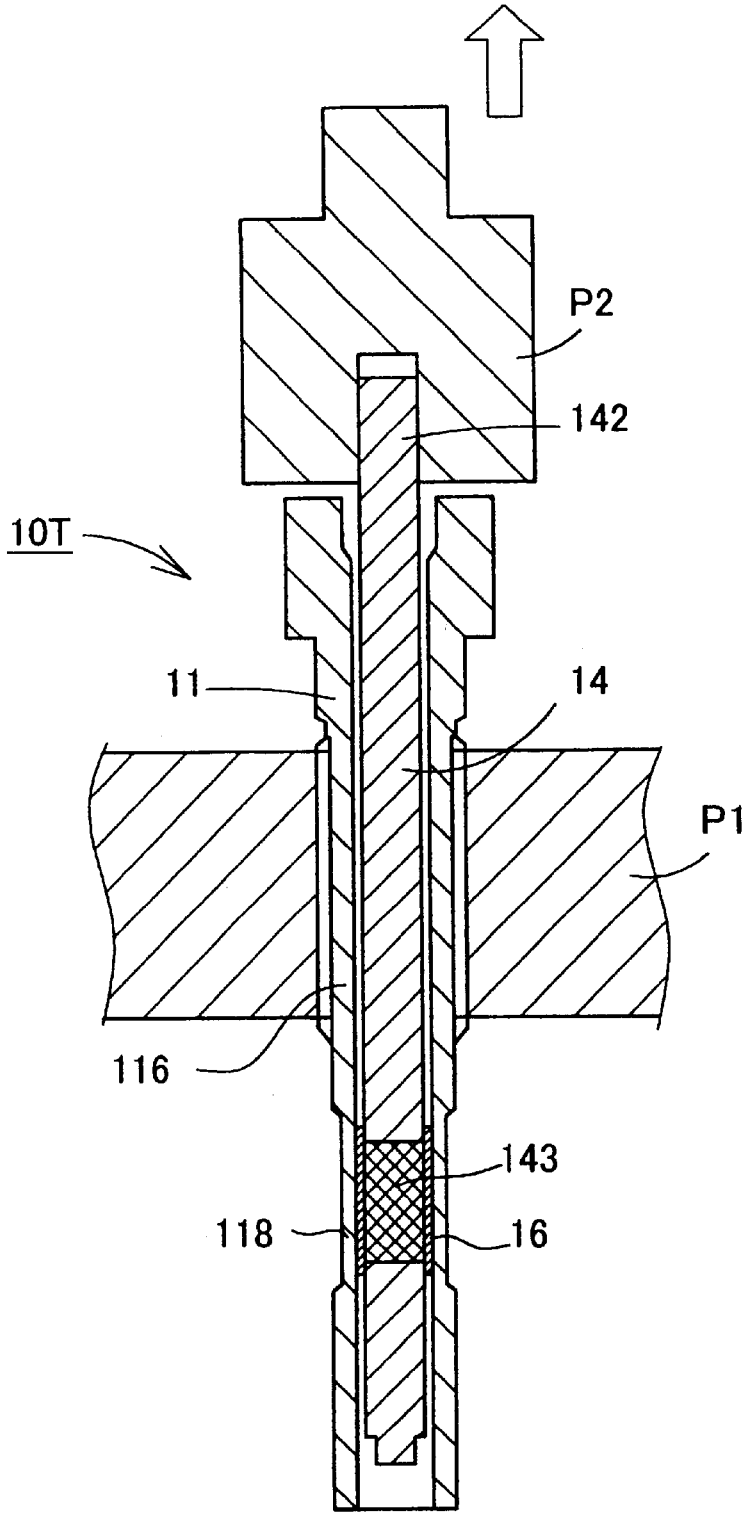
FIG. 6 is a partial cross-sectional view showing a tensile strength test on the axial member of the heater as embodied in a glow plug.

First, a tensile test on the axial member 14 will be described with reference to FIG. 6. In the tensile test, the axial member 14 is axially pulled.

The external terminal 17 and the insulation bush 18 are removed from the heater 10. The heater 10 is cut at a position corresponding to the coil lead 15 to thereby remove the heating element 12, the sleeve 13, and a front end portion of the metallic shell 11. This is intended to free the axial member 14 from the following restraint: the axial member 14 is connected to the heating element 12 by means of the coil lead 15, and the heating element 12 is fixedly attached to the metallic shell 11 via the sleeve 13 and through brazing.

The thus-cut heater 10T is fixedly attached to a tensile test jig P1 through screw engagement of the male-threaded portion 116 of the metallic shell 111 with a threaded hole of the jig P1. The rear end portion 142 of the axial member 14 is gripped by a gripper jig P2. As shown by the arrow in FIG. 6, the gripper jig P2 is moved rearward (upward in FIG. 6) so as to pull the axial member 14 in the axial direction. Tensile stress at the time when the axial member 14 is extracted from the metallic shell 11 is measured. In view of use of the heater 10 as a glow plug to be mounted on an engine, preferably, the axial member 12 has a tensile strength not less than 2,000 N.

Figure 7:
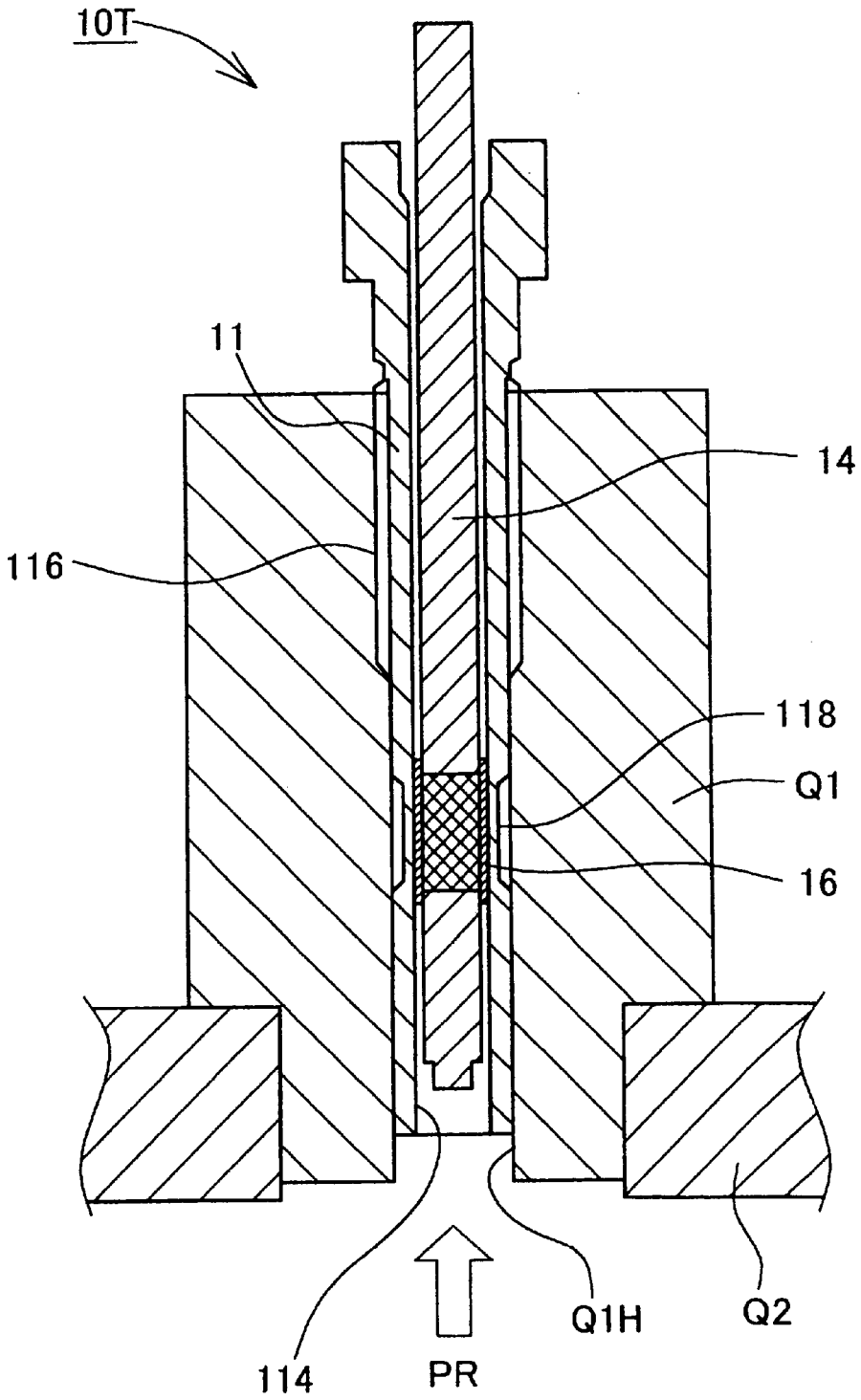
FIG. 7 is a partial cross-sectional view showing a gas-tight test on the heater as embodied in a glow plug.

Secondly, a gas-tightness test for examining gas-tightness to be established between the side toward the front end and the side toward the rear end with respect to the gas-tight seal member 16 will be described with reference to FIG. 7.

First, as in the case of the above-described tensile test, the external terminal 17 and the insulation bush 18 are removed from the heater 10. Further, the heater 10 is cut at a position corresponding to the coil lead 15 to thereby remove the heating element 12, the sleeve 13, and a front end portion of the metallic shell 11. This is intended to directly examine gas-tightness of the gas-tight seal member 16 by eliminating the influence of the insulation bush 18 and that of the heating member 12, which is fixedly attached to the metallic shell 11 via the sleeve 13 and brazing.

Subsequently, the thus-cut heater 10T is fixedly attached to a mounting jig Q1 through screw engagement of the male-threaded portion 116 of the metallic shell 11 with a female-threaded portion of a through-hole Q1 H of the jig Q1. Then, the mounting jig Q1 is gas-tightly attached to a gas-tight test jig Q2. As shown by the arrow in FIG. 7, gas pressure in the gas-tight test jig Q2 is increased to thereby apply pressure PR to the heater 1 OT. In the course of increasing the pressure PR, the heater 10T is checked for leakage of gas from the rear end through the through-hole 114. In view of use of the heater 10 as a glow plug to be mounted on an engine, preferably, no leakage arises even at a gas pressure of 1.5 MPa.

Figure 8:
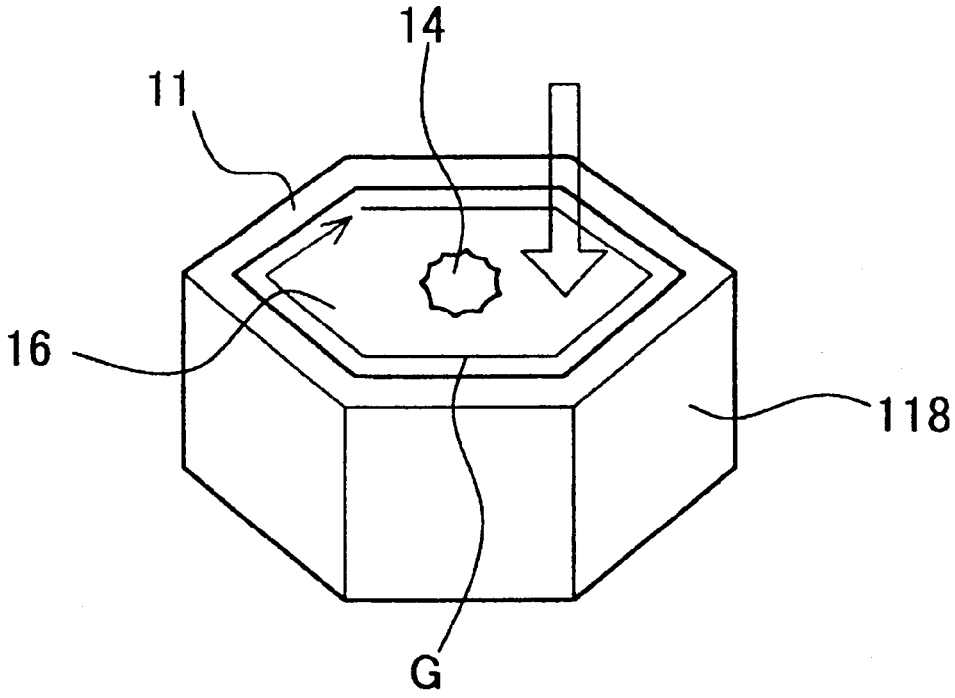
FIG. 8 is a partial cross-sectional view showing measurement of hardness of the gas-tight seal member after crimping.

Hardness of the gas-tight seal member 16 after crimping was measured in a manner shown in FIG. 8. Specifically, hardness of the gas-tight seal member 16 in a crimped state was measured in the following manner: the crimped portion 118 was cut crosswise (along a direction perpendicular to the axis), and an indenter was pressed against the cross section of the gas-tight seal member 16 sandwiched between the metallic shell 11 (crimped portion 118) and the central axial member 14, in the direction perpendicular to the cross section as represented by the arrow in FIG. 8 (in the axial direction of the axial member 14). In measurement of the hardness, a micro hardness tester and a Vickers indenter were used, and Vickers hardness was measured from an impression which was formed after the indenter was pressed against the cross section at a load of 100 g for 15 seconds.

Heaters 10 of different materials of the gas-tight seal member 16 and different lengths L of a crimped portion were manufactured and subjected to the above-described tests. The results are shown in the table of FIG. 9.

"30% GF polyamide" refers to a composite resin material which is formed such that polyamide contains glass fiber (GF) in an amount of 30% by weight. "PPA" refers to polyphthalamide. "Phenol A" and "Phenol B" are similar phenolic resins, but differ in hardness after curing.

The total contact area S between the gas-tight seal member 16 and the inner wall surface of the through-hole 114 was calculated from the cut pieces (see FIG. 8) used in the above-described measurement of hardness in the following manner: the length G of the inner circumference of the through-hole 114 (the outer circumference of the gas-tight seal member 16) in the crimped portion 116 was measured, and the product of the circumferential length G and the length L of the crimped portion 116 was obtained as the total contact area S (=G×L).

In the tensile strength test on the axial member, the symbol "O" denotes a tensile strength not less than 2,000 N, and the symbol "X" denotes a tensile strength less than 2,000 N. In the gas-tightness test, the symbol "O" denotes that no gas leakage occurred at a gas pressure of 1.5 MPa, and the symbol "X" denotes that gas leakage occurred at the gas pressure.

Modified Embodiment 1

Heaters according to Modified Embodiment 1 were manufactured such that the structure is similar to that of the heater 10 according to the above-described Embodiment, but the outside diameter, particularly a radial dimension, is smaller than that of the heater 10 (the nominal size of a male-threaded portion is M8). Similarly, the heaters according to Modified Embodiment 1 were subjected to the above-described tests. The results are shown in the table of FIG. 10. The heaters according to Modified Embodiment 1 have the following dimensions: a trunk portion of a metallic shell has an outside diameter D of 6.6 mm; a through-hole has a bore diameter K of 4.5 mm; a male-threaded portion has a nominal size of M8; a crimped portion of the metallic shell has a distance between opposed sides T of 6.0 mm; an axial member has an outside diameter C of 3.0 mm; and a gas-tight seal member has an outside diameter U of 4.4 mm and a length N of 15 mm, as measured before crimping.

Evaluation

As is apparent from the tables of FIGS. 9 and 10, when the Vickers hardness Hv of the gas-tight seal member 16 is less than 10; specifically, when the gas-tight seal member 16 is formed of polyamide, the tensile strength of the axial member 14 is less than 2,000 N (marked with "X"), regardless of the length L of the crimped portion (total contact area S). Conceivably, when the Vickers hardness of the gas-tight seal member 16 is less than 10, in the course of the tensile test, the gas-tight seal member is easily deformed and thus becomes likely to be extracted. In all of the tested heaters, the gas-tight seal member 16 was extracted from the through-hole 114 while being held on the axial member 14. Conceivably, since the outer circumferential surface 14S of the axial member 14 is roughened through knurling, the axial member 14 and the gas-tight seal member 16 are joined in a sufficiently strong manner.

When the Vickers hardness Hv of the gas-tight seal member 16 is not less than 80; specifically, when the gas-tight seal member 16 is formed of Phenol B, caused cracking of the gas-tight seal member 16; as a result, the tensile strength of the axial member 14 was less than 2,000 N (marked with "X"). Conceivably, when the Vickers hardness of the gas-tight seal member 16 is not less than 80, the gas-tight seal member 16 is too hard to be deformed in response to crimping stress, resulting in cracking of resin.

Therefore, an appropriate Vickers hardness Hv for a material used to form the gas-tight seal member 16 is 10–80.

When the Vickers hardness Hv of the gas-tight seal member 16 is less than 20; specifically, when the gas-tight seal member 16 is formed of 30% GF polyamide, the tensile strength of the axial member is low at a small value of the length L of the crimped portion (total contact area S). Specifically, the tensile strength of the axial member is low in the case of the heater 10 of the Embodiment having a length L of the crimped portion of 2.5 mm (total contact area S=41.5 $mm^2$) (see FIG. 9) and the heaters of Modified Embodiment 1 having a length L of the crimped portion of 2.5 mm (total contact area S=33.75 $mm^2$) and a length L of the crimped portion of 3.0 mm (total contact area S=40.5 $mm^2$) (see FIG. 10). Conceivably, when the length L of the crimped portion (total contact area S) assumes a small value, in the course of the tensile test, the gas-tight seal member 16 is easily deformed and thus becomes likely to be extracted.

Therefore, an appropriate Vickers hardness Hv for a material used to form the gas-tight seal member 16 is 20–80.

Further, in order to reliably prevent cracking or a like defect of the gas-tight seal member 16, an appropriate Vickers hardness Hv for a material used to form the gas-tight seal member 16 is 20–60.

The test results reveal that, when the total contact area S is small, sufficient gas-tightness is not established, regardless of the hardness of the gas-tight seal member 16; i.e., regardless of a material used to form the gas-tight seal member 16. Specifically, sufficient gas-tightness is not established in the case of the heater 10 of the Embodiment having a total contact area S of 41.5 $mm^2$ (see FIG. 9) and the heaters of Modified Embodiment 1 having a total contact area S of 33.75 $mm^2$ and 40.5 mm2 (see FIG. 10).

Therefore, an appropriate total contact area S is not less than 45 $mm^2$.

Modified Embodiment 2

Figure 11:
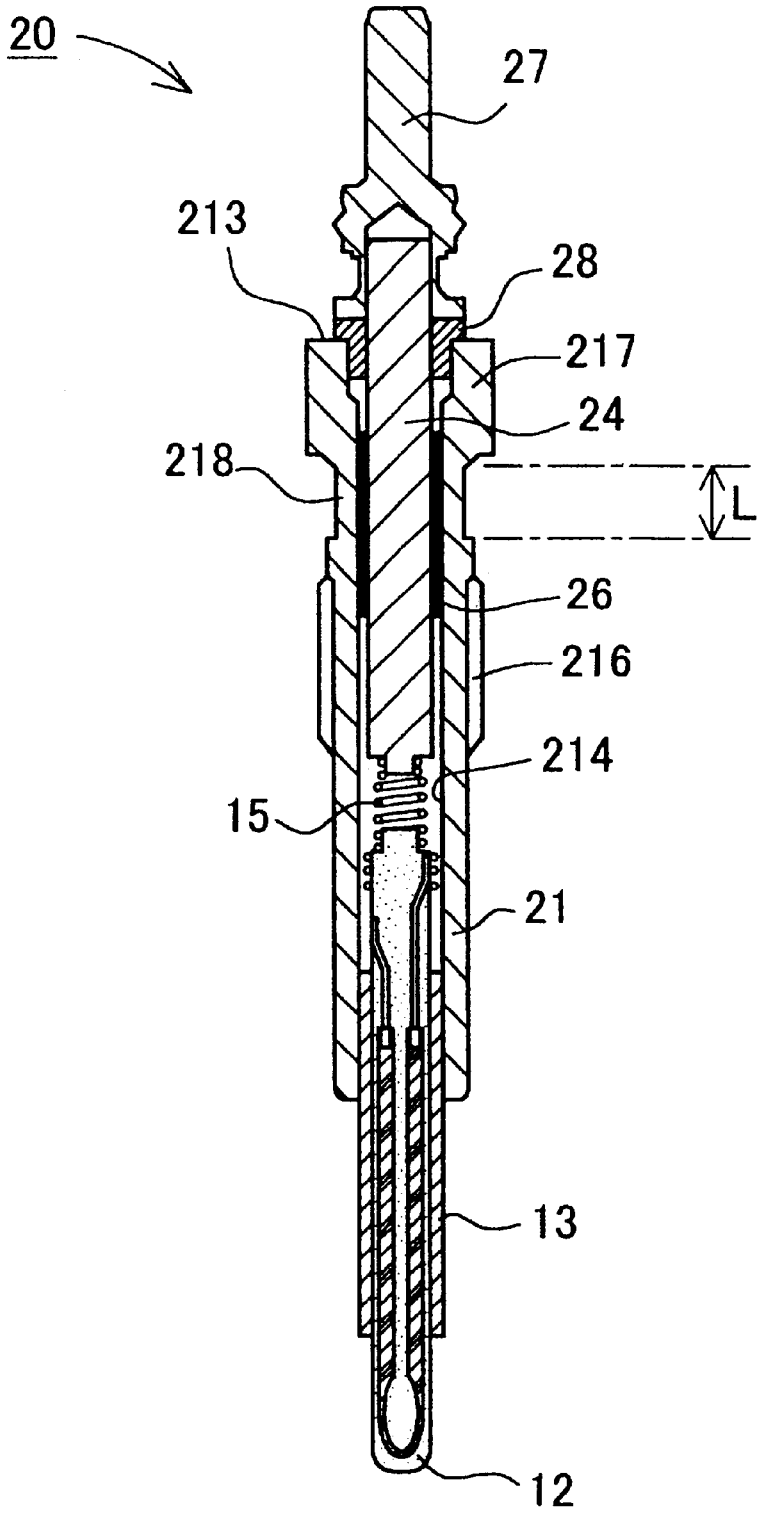
FIG. 11 is a cross-sectional view of a heater as embodied in a glow plug according to Embodiment 2 of the present invention.

As shown in FIG. 1, in the above-described Embodiment, the crimped portion 118 is formed on the trunk portion 115, which is located on the side toward the front end 112 with respect to the male-threaded portion 116. By contrast, as shown in FIG. 11, a heater 20 according to Modified Embodiment 1 is configured such that a crimped portion 218 is formed on the side toward a rear end 213 with respect to a male-threaded portion 216. That is, the heater 20 employs the heating element 12 and the sleeve 13 similar to those of the heater 10 of Embodiment 1; however, the metallic shell 21 and the axial member 24 are shorter than those of the heater 10. Accordingly, the crimped portion 218 is formed on the side toward the rear end 213 with respect to the male-threaded portion 216; specifically, between the male-threaded portion 216 and a tool engagement portion 217. A gas-tight seal member 26 is disposed inside the crimped portion 218 and between an axial member 24 and a through-hole 214 of a metallic shell 21. Thus, also in the heater 20, the axial member 24 is held in the metallic shell 21, and the gas-tight seal member 26 can maintain gas-tightness between the side toward the front end 212 of the metallic shell 21 and the side toward the rear end 213 of the metallic shell 21.

While the present invention has been described with reference to the embodiment and the modified embodiments, the present invention is not limited thereto, but may be modified as appropriate without departing from the spirit or scope of the invention.

For example, the embodiment and the modified embodiments are described above while mentioning formation of a single crimped portion 118 or 218. However, a plurality of crimped portions may be formed. When a plurality of crimped portions are formed, gas-tightness is further enhanced. The embodiment and the modified embodiments are described above while mentioning the insulation bush disposed at a rear end portion of the metallic shell and adapted to hold the axial member. However, in order to establish higher gas-tightness or to more reliably hold the axial member, a crimped portion may be formed, and, as in the case of the aforementioned conventional heater, the axial member may be held and sealed by use of a glass seal and an O-ring.

According to the embodiment and the modified embodiments described above, the heating element 12 is configured such that the electrically conductive portion 122 is formed within the insulating ceramic portion 121. However, an electrically conductive portion may be exposed at the surface of an insulating ceramic portion. Alternatively, there may be used a sheath heater configured such that a heating resistance wire is held within a metallic sheath filled with a heat resistant insulation powder such as MgO. When this sheath heater is used, a heat resistant insulation powder such as MgO is prone to impairment in insulating property induced by moisture absorption. Therefore, in order to prevent entry of water, water vapor, or the like from the rear end of a metallic shell, establishment of high gas-tightness as implemented by the present invention is preferred.

The embodiment and the modified embodiments are described above while mentioning the heater 10 having the male-threaded portion 116 and the heater 20 having the male-threaded portion 216. However, the present invention can be applied to a heater whose metallic shell does not have a male-threaded portion.

What is claimed is:

1. A heater comprising:

a cylindrical metallic shell having a front end, a rear end, and a through-hole extending therein between the front end and the rear end;

a heating element disposed in the through-hole of the metallic shell such that a portion thereof projects from the front end of the metallic shell, said heating element being adapted to generate heat upon application of electricity thereto;

a lead member extending through the through-hole at least from the rear end of the metallic shell while being electrically insulated from the metallic shell, said lead member being electrically connected to the heating element; and a gas-tight seal member comprised of an insulating polymeric material interposed between the lead member and an inner wall surface of the through-hole of the metallic shell in such a manner as to surround at least a longitudinal portion of the lead member, wherein the metallic shell including a crimped portion bringing the gas-tight seal member into close contact with the lead member and the inner wall surface of the through-hole, to thereby maintain gas-tightness within the through-hole between the front end and the rear end with respect to the gas-tight seal member.

2. A heater according to claim 1, having a gas-tightness such that no leakage arises upon application of a gas pressure of 1.5 MPa to the gas-tight seal member from the front end.

3. A heater according to claim 2, further having a total contact area between the gas-tight seal member and the inner wall surface of the through-hole equal to or greater than 45 $mm^2$.

4. A heater according to claim 3, wherein the lead member comprises a rodlike axial member and a connection member for electrically connecting a front end portion of the lead member and the heating element, the gas-tight seal member is interposed between the axial member and the inner wall surface of the through-hole of the metallic shell to surround at least a longitudinal portion of the axial member.

5. A heater according to claim 4, the outer circumferential surface of the axial member to be covered with the gas-tight seal member being at least partially roughened.

6. A heater according to claim 5, the gas-tight seal member having a Vickers hardness HV of 10–80 as measured at a position located radially inward of the crimped portion.

7. A heater according to claim 2, wherein the lead member comprises a rodlike axial member and a connection member for electrically connecting a front end portion of the lead member and the heating element; the gas-tight seal member being interposed between the axial member and the inner wall surface of the through-hole of the metallic shell in such a manner as to surround at least a longitudinal portion of the axial member.

8. A heater according to claim 7, the outer circumferential surface of the axial member to be covered with the gas-tight seal member being at least partially roughened.

9. A heater according to claim 8, the gas-tight seal member having a Vickers hardness HV of 10–80 as measured at a position located radially inward of the crimped portion.

10. A heater according to claim 1, wherein the lead member comprises a rodlike axial member and a connection member for electrically connecting a front end portion of the lead member and the heating element, the gas-tight seal member being interposed between the axial member and the inner wall surface of the through-hole of the metallic shell to surround at least a longitudinal portion of the axial member.

11. A heater according to claim 10, the portion of the outer circumferential surface of the axial member to be covered with the gas-tight seal member being at least partially roughened.

12. A heater according to claim 11, wherein the gas-tight seal member has a Vickers hardness HV of 10–80 as measured at a position located radially inward of the crimped portion.

13. A heater for heating the fuel of an internal combustion engine, said heater comprising:

a cylindrical shell having an axial through-hole extending therethrough;

an electrically heated heating element disposed in the through-hole;

a lead member extending through the through-hole electrically connected to the heating element and electrically insulated from the metallic shell; and a seal member comprised of an insulating polymeric material interposed between the lead member and an inner wall surface of the through-hole surrounding at least a longitudinal portion of the lead member, seal member being in close contact with the lead member and the inner wall surface of the through-hole as a result of the shell being radially deformed to compress the seal member.

14. A heater according to claim 13, wherein no leakage past said seal member arises upon application of a gas pressure of 1.5 MPa to the seal.

15. A heater according to claim 14, further having a total contact area between the seal member and the inner wall surface of the through-hole equal to or greater than 45 $mm^2$.

16. A heater according to claim 15, wherein said polymeric material consists essentially of a heat-resistant polymeric material capable of sealing said lead member and said shell at temperatures up to 150° C.

17. A method for manufacturing a heater, comprising the steps of:

providing a heating-element-lead-member assembly including a heating element adapted to generate heat upon application of electricity thereto, a lead member electrically connected to the heating element, and a gas-tight seal member formed of an insulating polymeric material and surrounding at least a certain longitudinal portion of the lead member;

providing a cylindrical metallic shell having a front end, a rear end, and a through-hole extending therein between the front end and the rear end;

disposing the heating-element-lead-member assembly in the through-hole of the metallic shell in such a manner that a portion of the heating element projects from the front end of the metallic shell, and the lead member extends to the rear end of the metallic shell; and crimping the metallic shell from an outer surface thereof so as to bring the gas-tight seal member into close contact with the lead member and an inner wall surface of the through-hole, to thereby maintain gas-tightness within the through-hole between a side toward the front end and a side toward the rear end with respect to the gas-tight seal member.

18. A method for manufacturing a heater, comprising the steps of:

providing a heating-element-axial-member assembly including a heating element adapted to generate heat upon supply of electricity thereto, an axial member formed of a metal, a gas-tight seal member formed of an insulating polymeric material and surrounding at least a certain longitudinal portion of the axial member, and a connection member for electrically connecting the heating element and a front end portion of the axial member;

providing a cylindrical metallic shell having a front end, a rear end, and a through-hole extending therein between the front end and the rear end;

disposing the heating-element-axial-member assembly in the through-hole of the metallic shell in such a manner that a portion of the heating element projects from the front end of the metallic shell; and crimping the metallic shell from an outer surface thereof so as to bring the gas-tight seal member into close contact with the axial member and an inner wall surface of the through-hole, to thereby maintain gas-tightness within the through-hole between a side toward the front end and a side toward the rear end with respect to the gas-tight seal member.

* * * * *